United States Patent [19]

Adams et al.

[11] 4,074,690

[45] Feb. 21, 1978

[54] PRE-ADJUSTED CONTROL MODULE FOR CONSTRUCTION VEHICLES

[75] Inventors: Stanley B. Adams, Yorkville; Frederick A. Carbaugh, East Aurora; John R. Cryder, Joliet, all of Ill.

[73] Assignee: Caterpillar Tractor Co., Peoria, Ill.

[21] Appl. No.: 674,785

[22] Filed: Apr. 8, 1976

[51] Int. Cl.[2] ..... G05G 1/04; G05G 13/00

[52] U.S. Cl. ..... 137/344; 74/491; 74/527; 251/297

[58] Field of Search ..... 74/475, 491, 523, 527; 251/297; 137/344, 351, 354; 214/762, 764

[56] References Cited

U.S. PATENT DOCUMENTS

| | | | |
|---|---|---|---|
| 3,372,606 | 3/1968 | McGrath et al. | 74/491 |
| 3,492,889 | 2/1970 | Hauff | 74/491 X |
| 3,519,155 | 7/1970 | Jefferson et al. | 214/764 |
| 3,792,744 | 2/1974 | Gray | 74/491 X |

*Primary Examiner*—Martin P. Schwadron
*Assistant Examiner*—Richard Gerard
*Attorney, Agent, or Firm*—Phillips, Moore, Weissenberger, Lempio & Majestic

[57] ABSTRACT

A pre-adjusted control module comprises a bracket assembly adapted for attachment to a support structure of a construction vehicle. A control lever is pivotally mounted within the bracket assembly along with a bellcrank having a roller mounted on a first arm thereof. The roller is adapted to selectively engage either one of two notches formed on a lower end of the control lever and is biased in that direction by a tension coil spring connected between the bracket assembly and a second arm of the bellcrank. A control rod is reciprocally mounted in the bracket assembly and has its first end pivotally connected to the control lever and is adapted to have its second end connected to a self-centering valve spool of a directional control valve. A pread-justed sensing means, including a compression coil spring, is connected between the bracket assembly and the control rod to alert the operator upon approach of one of the two detent positions of the control lever, as effected by engagement of the roller with one of the two notches formed on the control lever.

17 Claims, 4 Drawing Figures

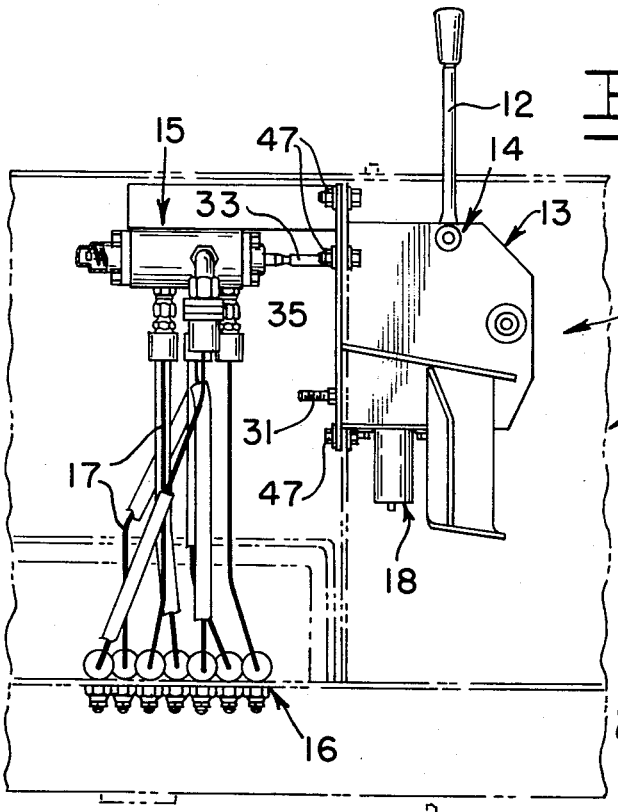
Fig. 1.
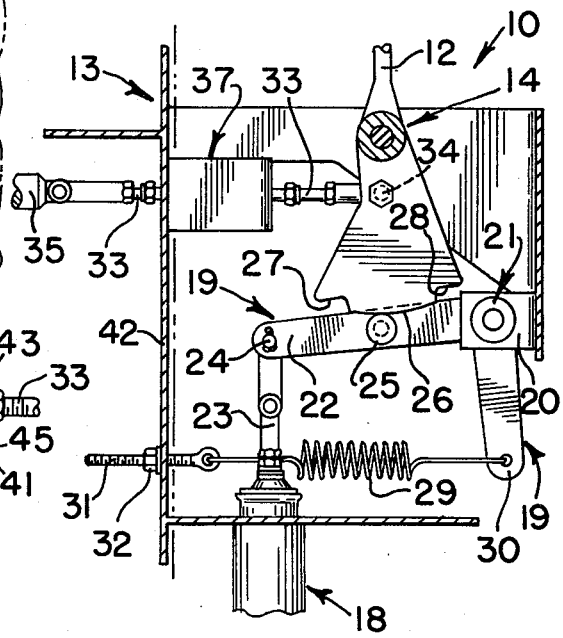
Fig. 3.
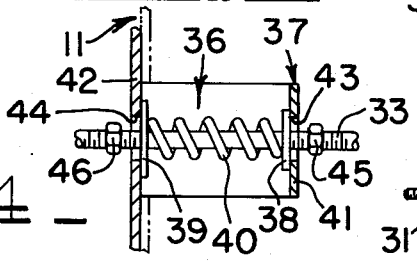
Fig. 4.
Fig. 2.
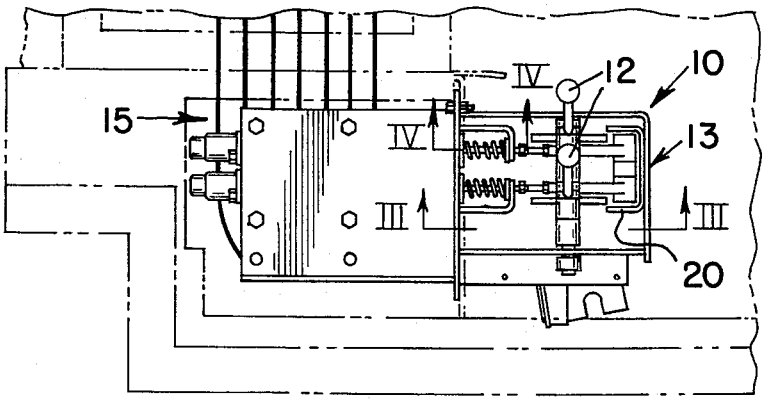

PRE-ADJUSTED CONTROL MODULE FOR CONSTRUCTION VEHICLES

BACKGROUND OF THE INVENTION

The pilot-operated hydraulic control group for selectively moving a loader bucket on a wheel loader in various positions of operation thereon comprises a directional control valve adapted to be actuated by a control lever. A detent mechanism is normally associated with the control lever to hold it in selected conditions of operation (e.g., rack-back, raise, float) to release the operator's hand for actuation of other control levers. The detent mechanism is further operatively associated with a kick-out mechanism for releasing the detent mechanism in response to raising or lowering of the loader bucket.

Upon such release of the detent mechanism, a centering spring, normally enclosed within the valve body of the directional control valve, will function to return the valve spool thereof and the control lever to neutral or hold conditions of operation. The control group is normally mounted on the vehicle and is thereafter adjusted to coordinate the various positions of the control lever, valve spool and detent mechanism. An example of such a control group is disclosed in U.S. Pat. No. 3,519,155, assigned to the assignee of this application.

SUMMARY OF THIS INVENTION

An object of this invention is to provide a non-complex and compact control module which is adapted to be pre-adjusted prior to its mounting on a vehicle. The control module comprises a bracket assembly adapted for attachment on the vehicle and a control lever pivotally mounted on the bracket assembly. Releasable holding means, preferably comprising a bellcrank also pivotally mounted on the bracket assembly, functions to selectively hold the control lever in at least one pivoted, detent position thereof on the bracket assembly.

A control rod is reciprocally mounted in the bracket assembly and has a first end thereof pivotally connected to the control lever and is adapted to have a second end thereof connected to the valve spool of a self-centering directional control valve. A pre-adjusted sensing means is operatively connected between the bracket assembly and the control rod to alert the operator upon the approach of the detent position of the control lever.

BRIEF DESCRIPTION OF THE DRAWINGS

Other objects of this invention will become apparent from the following description and accompanying drawings wherein:

FIG. 1 is a side elevational view of a pre-adjusted control module of this invention mounted on a support structure of a construction vehicle, shown in phantom lines;

FIG. 2 is a top plan view of the control module;

FIG. 3 is an enlarged sectional view in elevation of the control module, taken in the direction of arrows III—III in FIG. 2; and FIG. 4 is an enlarged sectional view of a sensing means employed in the control module, taken in the direction of arrows IV—IV in FIG. 2.

DETAILED DESCRIPTION

FIGS. 1 and 2 illustrate a pre-adjusted control module 10 of this invention detachably mounted on a support structure 11 of a construction vehicle, the support structure being shown in phantom lines. The control module comprises a pair of control levers 12 each pivotally mounted on a common bracket assembly 13 by a pivot means 14 for selectively actuating a self-centering directional control or pilot valve 15. The valve may be of the type adapted to selectively communicate pressurized fluid to a manifold block 16 and/or to exhaust fluid therefrom via lines 17 in a conventional manner.

For example, the control module of this invention is particularly adapted for use on a wheel loader for selectively moving the lift arms and loader bucket thereof to various positions of operation by suitably arranged lift cylinders and a tilt linkage (not shown). In such an application, the standard solenoid 18 may be suitably slaved to a bucket kick-out mechanism responsive to movement of a component of the loader bucket assembly to release control lever 12 to permit automatic return thereof to a preselected position which, in turn, places directional control valve 15 in a neutral or hold condition of operation. As will be hereinafter more fully understood, the control module is adapted to be pre-adjusted and thereafter installed on support structure 11 of the vehicle in contrast to conventional control groups which are adjusted in situ on the vehicle.

Referring to FIG. 3, a releasable holding means for selectively locking each control lever 12 in one of two pivoted or detent positions on bracket assembly 13 comprises a bellcrank 19 pivotally mounted on a U-shaped bracket 20 (FIG. 2), secured interiorly of bracket assembly 13, by a pivot means 21. The bellcrank has a first arm 22 extending within the confines of the bracket assembly to have its outer end pivotally connected to a plunger 23 of solenoid 18 by a pivot pin 24. A follower or roller 25 is rotatably mounted on arm 22, between pivot means 21 and pin 24, to normally engage an arcuate cam 26 formed on a lower end of control lever 12.

A pair of notches 27 and 28 are also formed on the lower end of the control lever and are disposed on either side of cam 26 to selectively receive roller 25 therein upon manipulation of the control lever. A tension coil spring 29 has a first end thereof anchored to a second downwardly extending arm 30 of the bellcrank and a second end thereof anchored to bracket assembly 13. The latter anchor preferably comprises an eye bolt 31 threadably mounted in a nut 32 secured on an interior plate of the bracket assembly to provide adjustment means for preadjusting the tension on spring 29 whereby roller 25 is biased against control lever 12 under a predetermined force.

Referring to FIGS. 3 and 4, an axially adjustable control rod 33 has a first end thereof pivotally connected to control lever 12, intermediate pivot means 14 and cam 26, by a pin 34. The second end of the control rod is suitably connected in a conventional manner to a self-centering valve spool 35, reciprocally mounted in directional control valve 15 (FIG. 1). FIG. 4 more clearly illustrates a sensing means 36 for the control rod for altering the operator by feel upon approach of each of the two detent positions of the control lever as dictated by engagement of roller 25 with one of the two notches 27 or 28. When control lever 12 is released from its detent positions, it will move automatically to its FIG. 3 position wherein roller 25 engages cam 26 and self-centering valve spool 35 will thus be placed in a hold, neutral or other preselected condition of valve operation.

As shown in FIG. 4, the sensing means comprises a bracket 37 integrally secured within the confines of bracket assembly 13 to expose the same for pre-adjusting and servicing purposes. The sensing means further comprises a pair of axially spaced annular washers 38 and 39 reciprocally mounted on control rod 33. A compression coil or bumper spring 40 is mounted on the control rod to normally expand washers 38 and 39 into abutment with an end plate 41 of bracket 37 and a mounting plate 42 of bracket assembly 13, respectively.

A pair of axially aligned circular openings 43 and 44 are formed through plates 41 and 42, respectively, to reciprocally mount control rod 33 therethrough. The outer diameters of such openings are less than the outer diameters of washers 38 and 39 to prevent the washers from moving therethrough. A pair of nuts 45 and 46 are threadably mounted on the control rod to provide axially spaced stop means disposed on the outboard sides of and axially spaced from the washers for alternately engaging and moving the washers against the counteracting force of spring 40 upon reciprocation of the control lever 12 in either direction. The outer dimensions of the nuts are less than the inside diameters of the openings to permit them to reciprocate therethrough to effect such compression of the coil spring.

Subsequent to pre-adjustment of the control module to coordinate the movements and relative positions of control lever 12, bellcrank 19, solenoid plunger 23 and valve spool 35, the control module is suitably attached on support structure 11 of the vehicle by a plurality of bolts 47 (FIG. 1). Since the housing of directional control valve 15 is suitably premounted on bracket assembly 13 along with the other components of the control module, the control module need undergo little, if any, further adjustment to place it in condition for operation, subsequent to the interconnection of conduits 17 between the directional control valve and manifold block 16. It should be further noted that should any servicing be required in the area of the control lever, sensing means 36, bellcrank or solenoid, that the same may be accomplished expeditiously due to the substantially exposed and serviceable positions thereof on the vehicle.

We claim:

1. A control module adapted for preadjustment and mounting on a vehicle comprising a bracket assembly adapted for attachment to a support structure of said vehicle, a control lever, pivot means pivotally mounting said control lever on said bracket assembly, releasable holding means for selectively holding said control lever in at least one pivoted position thereof on said bracket assembly comprising a bellcrank pivotally mounted on said bracket assembly, follower means mounted on said bellcrank and notch means formed on said control lever and adapted to selectively engage said follower for holding said control lever in said pivoted position, a control rod reciprocally mounted in said bracket assembly and having a first end thereof pivotally connected to said control lever and adapted to have a second end thereof connected to a control valve, and pre-adjusted sensing means connected between said bracket assembly and said control rod for alerting an operator by feel upon approach of said pivoted position of said control lever.

2. The control module of claim 1 further comprising a control valve mounted on said bracket assembly, a self-centering valve spool reciprocally mounted in said control valve and wherein said control rod is connected to said valve spool to reciprocate the same upon the pivoting of said control lever.

3. The control module of claim 2 further comprising a support structure of a vehicle and wherein said bracket assembly is detachably mounted on said support structure.

4. The control module of claim 3 further comprising a manifold block mounted on said support structure and a plurality of conduits interconnected between said control valve and said manifold block.

5. The control module of claim 1 wherein a pair of said control levers are pivotally mounted within said bracket assembly by said pivot means.

6. The control module of claim 1 wherein said bellcrank comprises a first arm having said follower means mounted thereon and a second arm and further comprising tension spring means interconnected between the second arm of said bellcrank and said bracket assembly for pivoting said bellcrank to urge said follower into said notch means.

7. The control module of claim 6 further comprising an arcuate cam formed on a lower end of said control lever and wherein said notch means comprises a pair of notches formed on the lower end of said control lever and disposed on either side of said arcuate cam.

8. The control module of claim 6 further comprising means mounting an end of said tension spring means on said bracket assembly for selectively adjusting the tension thereof.

9. The control module of claim 6 further comprising a solenoid mounted on said bracket assembly and a plunger reciprocally mounted in said solenoid and wherein an end of the first arm of said bellcrank is pivotally connected to said plunger.

10. The control module of claim 1 wherein said sensing means comprises a bracket secured on a mounting plate of said bracket assembly and wherein said control rod is reciprocally mounted in a pair of aligned openings formed through said bracket and through said plate.

11. The control module of claim 10 wherein said sensing means further comprises a compression coil spring mounted on said control rod, a pair of axially spaced annular washers slidably mounted on said control rod and disposed at opposite ends of said spring.

12. The control module of claim 11 wherein each of said openings is circular and each of said washers has an outside diameter which is larger than the inside diameters of said openings.

13. The control module of claim 12 wherein one of said washers normally abuts the plate of said bracket assembly and the other one of said washers normally abuts said bracket.

14. The control module of claim 13 wherein said sensing means further comprises a pair of stop means fixedly attached in axially spaced locations on said control rod and each mounted adjacent to an outboard side of a respective one of said washers in axially spaced relationship therewith.

15. The control module of claim 14 wherein each of said stop means constitutes a nut threadably mounted on said control rod.

16. The control module of claim 15 wherein each of said nuts has an outer dimension less than the inside diameters of said openings.

17. A control module adapted for preadjustment and mounting on a vehicle comprising a bracket assembly adapted for attachment to a support structure of said vehicle, a control lever, pivot means pivotally mounting said control lever on said bracket assembly, releasable holding means for selectively holding said control lever in at least one pivoted position thereof on said bracket assembly, a control rod reciprocally mounted in said bracket assembly and having a first end thereof pivotally connected to said control lever and adapted to have a second end thereof connected to a control valve, and pre-adjusted sensing means connected between said bracket assembly and said control rod for alerting an operator by feel upon approach of said pivoted position of said control lever comprising a bracket secured on a mounting plate of said bracket assembly and wherein said control rod is reciprocally mounted in a pair of aligned openings formed through said bracket and through said plate.

* * * * *